US005129321A

United States Patent [19]

Fadner

[11] Patent Number: 5,129,321

[45] Date of Patent: Jul. 14, 1992

[54] DIRECT-TO-PRESS IMAGING SYSTEM FOR USE IN LITHOGRAPHIC PRINTING

[75] Inventor: Thomas A. Fadner, LaGrange, Ill.

[73] Assignee: Rockwell International Corporation, El Segundo, Calif.

[21] Appl. No.: 726,614

[22] Filed: Jul. 8, 1991

[51] Int. Cl.[5] ..... B41C 1/10

[52] U.S. Cl. ..... 101/467; 101/465; 346/74.2

[58] Field of Search ..... 101/141, 142, 450.1, 101/451, 452, 463.1, 465, 466, 467; 346/74.2, 74.6

[56] References Cited

U.S. PATENT DOCUMENTS

| | | | |
|---|---|---|---|
| 3,791,843 | 2/1974 | Kohlmannsperger | 101/467 X |
| 4,833,990 | 5/1989 | Hirt et al. | 101/467 X |
| 4,846,065 | 7/1989 | Mayrhofer et al. | 101/467 X |
| 4,872,962 | 10/1989 | Scheer et al. | 204/224 R |
| 4,959,668 | 9/1990 | Hirt | 346/155 |

*Primary Examiner*—Clifford D. Crowder

*Attorney, Agent, or Firm*—C. B. Patti; V. L. Sewell; H. F. Hamann

[57] ABSTRACT

A direct-to-press imaging system for use in lithographic printing wherein a master-image printing cylinder is used with separate application of ink and water onto its surface to enable repetitive conveyance of image-formatted ink films onto substrates for printing purposes. The imaging system includes a master-image printing cylinder adapted for receiving a hydrophilic coating layer on its surface and a device for laying down a uniform layer of hydrophilic material on the surface of this cylinder. An apparatus is also provided for applying oleophilic material in image-formatted patterns on top of the layer of hydrophilic material on the master-image printing cylinder to form a printing structure having separate hydrophilic and oleophilic areas of the format to be printed. Further, a mechanism is provided for removing the printing structure including both the hydrophilic and oleophilic materials from the surface of the master-image printing cylinder so that a new printing structure corresponding to a new image to be printed can be formed on the master-image printing cylinder.

24 Claims, 3 Drawing Sheets

DIRECT-TO-PRESS IMAGING SYSTEM FOR USE IN LITHOGRAPHIC PRINTING

BACKGROUND OF THE INVENTION

The present invention relates to high speed lithographic printing techniques and more particularly to direct-to-press imaging systems for use in forming printing images directly on a printing cylinder used in printing operations.

In accordance with conventional lithographic printing practices for printing continuous webs of paper, ink in desired image patterns is conveyed from inked printing plates that are attached to plate cylinders and thence by means of a blanket cylinder having a more or less compressible surface onto the paper. The printing plate carries a differentiated image on a dimensionally stable substrate such as an aluminum sheet. The imaged aluminum plate is secured to the plate cylinder by a mechanical lock-up mechanism which defines positional register between the plate and the surface of the cylinder. When new images are to be printed, the mechanical lock-up system is released so that the printing plate carrying the old image can be removed and discarded and a newly imaged printing plate can be positioned and locked into place for the next print run.

In the past, press-ready lithographic printing plates have been prepared off-press by forming the required ink receptive image areas and water receptive non-image areas on suitable printing plate surfaces in a manner similar to photographic development. Preparation can be by means of hand operation or by means of readily available automatic developing and processing machines. Once having been imaged, printing plates generally are hand carried to the vicinity of the printing press and fixedly attached to the printing cylinder by press operators using the lock-up mechanism built into the cylinder itself. Although the attachment of the printing plates to the printing cylinder is generally a manual operation, robotic means can be used for positioning and securing printing plates.

Operations involving off-press imaging and manual mounting of printing plates are relatively slow and cumbersome. On the other hand, high speed information processing technologies are in place today in the form of pre-press composition systems which can electronically handle all the data required for directly generating the images to be printed. Almost all large scale printing operations currently utilize electronic pre-press composition systems that provide the capability for direct digital proofing using video displays and visible hard copies produced from digital text and digital color separation signals stored in computer memory and which can also be used to express page-composed images to be printed in terms of rasterised digitized signals. Consequently, conventional imaging systems whereby the printing images are generated off-press by means of paste-up, mechanical layout, photographic film-making, or plate exposure and development operations which create a physical printing plate that must be mounted on a printing cylinder constitute or induce inefficient and expensive bottle-necks in printing operations.

It is therefore an object of the present invention to provide a system whereby digitized graphic information typical of electronic pre-press composition systems can be bridged directly to conventional high speed, high volume printing presses without the necessity for handling any form of hard copy, film material or printing plate.

It is another object of the present invention to provide a system for applying digitally formed master images directly onto master-image cylinders and for automatically erasing such images from such cylinders so that new images can be applied thereto.

It is a further object of the present invention to minimize the dependence upon operator skill and the susceptibility to human error in the conveyance of image information from electronic prepress composition systems to the actual printing presses.

It is yet another object of the present invention to eliminate or reduce the need for intermediate image processing materials and equipment such as photographic film, metallic or other printing plates, chemical process systems associated with film or plate making and the like.

It is a yet further object of the present invention to eliminate the need for mechanical lock-up and pin register systems and the like used in mounting printing plates onto printing cylinders.

SUMMARY OF THE INVENTION

The present invention constitutes a direct-to-press imaging system for use in lithographic printing in which a master lithographic image structure having separate hydrophilic and oleophilic areas corresponding to non-image and image areas is formed directly in place on a master-image printing cylinder of a printing press and then used in more-or-less conventional printing operations. The printing image structure is constructed so that it may be readily removed from the printing cylinder and a new lithographic image structure can be laid down on the master-image printing cylinder for printing new images. In accordance with the principles of the present invention a hydrophilic layer is first applied to the master-image printing cylinder. Oleophilic materials are then fixedly applied on top of the hydrophilic layer in an image-formatted pattern thereby creating a lithographic printing structure having non-image areas which are water receptive and image areas which are ink receptive. When it is desired to print new images the hydrophilic layer together with the oleophilic material are stripped off of the master-image printing cylinder. A new master-image printing structure corresponding to the new image to be printed may then be applied to the master-image printing cylinder.

In the preferred embodiment, the master-image carrying cylinder includes a magnetizable surface layer. A magnetically active hydrophilic powder is applied onto the surface of the master-image cylinder to form a fixedly held hydrophilic coating layer. Fusible oleophilic image material is then transferred in image-formatted patterns onto the coating layer. The oleophilic materials are then fused by the application of radiant heat or the like thereby forming a durable lithographic master printing image structure on the master-image cylinder having the necessary separate hydrophilic and oleophilic areas corresponding to non-image and image areas of the format to be printed. A scraper and counter-magnet are provided for removing the whole lithographic master printing structure including both the hydrophilic coating layer and the oleophilic image material from the master-image carrying cylinder.

DESCRIPTION OF THE PREFERRED EMBODIMENT

Figure 1A:
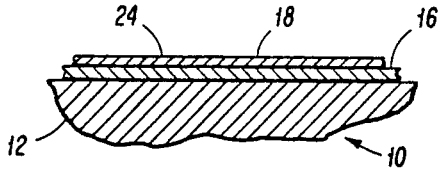
FIGS. 1A–1E provide partial cross-sections of segments of a master-image carrying cylinder which diagrammatically illustrate the process steps and devices which characterize the preferred embodiment of the present invention.

Referring now to FIGS. 1A–1E, the basic steps in the present invention are diagrammatically illustrated showing how a printing image structure 20 can be built up on a master-image cylinder 10 and subsequently removed so that it can be replaced with a new printing structure. FIG. 1A shows a section of a master-image printing cylinder 10 including a base cylinder 12 which has a conventionally hard smooth surface and which is made of cast-iron, aluminum, chrome-plated steel or the like.

The base cylinder 12 has a magnetizable layer 16 permanently overlaid on its surface 14 which may in turn be covered with a non-magnetic permanent wear or protective layer 18. The magnetizable layer 16 may be composed of any of a number of highly magnetic materials such as gamma ferric oxide, chromium dioxide or ferric metal alloy particles dispersed and suspended in a binder to form a composition which is permanently adhered onto the base cylinder 12. The layer 16 is constructed to allow for a strong and uniform magnetic field to extend out 10 to 100 microns from the layer 16 so as to fixedly hold a thin layer of magnetic powder in place on the outer surface 24 of the master-image cylinder 10. The protective layer 18 may comprise a thin coating of ceramic or any other non-magnetic wear resistant material having sufficient durability to help protect the magnetizable layer 16 from potential damage of the type that may be incurred when presses are operating at high speeds in commercial printing environments.

Figure 1B:
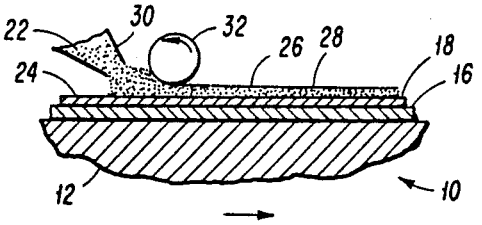

Referring now to FIG. 1B the surface of the printing cylinder 10 is rotated past a hopper 30 which is operative for uniformly dispensing a magnetically active powder 22 onto the surface of the printing cylinder 10 and more particularly onto the surface of the wear layer 18 (or magnetic layer 16) to form a layer 26 of hydrophilic powder on the outer surface 24 of the printing cylinder 10. The powder 22 may comprise any number of very fine magnetically active (e.g. ferromagnetic) particles which are coated with non-reactive materials providing a hydrophilic character to the powder 22. The particles making up the powder 22 should preferably be characterized by highly magnetic properties and have a shape and size distribution that will result in an applied void volume ranging between 30 and 70 percent of the nominal value of the powder material when it is compressed in order to allow for control over the packing density of the layer 26. The roller 32 is used to apply pressure to the coating layer 26 so as to control packing density and regulate uniformity of the layer 26 so that a magnetically well bonded yet porous layer 26 is provided along the outer surface 24 of the master-image printing cylinder 10. The powder layer 26 is thereby adapted for retaining the dampening water required for lithographic printing and for adhesion of oleophilic materials on its own surface 28 as it is fixedly held in place by magnetic forces sufficient to resist delamination tendencies during printing operations.

Figure 1C:
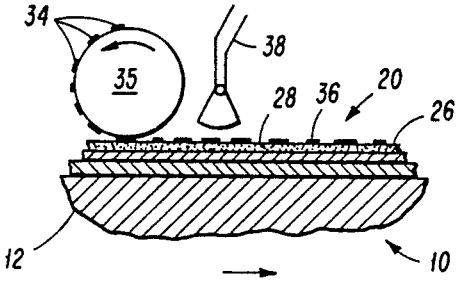

Referring now to FIG. 1C, oleophilic materials 34 which are fusible into fixed and durable compositions are deposited onto the surface 28 of the powder coating layer 26 in a formatted pattern reflecting an image desired to be printed in order to produce an image-formatted layer 36 of oleophilic (and hydrophobic) materials. The oleophilic materials 34 are delivered off of the drum 35 which is intended to represent any of a number of means of forming oleophilic materials into image-formatted patterns and applying them to the surface 28 such as a magnetographic system of the type which will be described hereinafter with reference to FIG. 5. Once the oleophilic materials are deposited on the surface 28 of the coating layer 26 they are fused into a durable pattern for instance by application of heat from the radiant heater 38. A robust printing structure 20 is thereby formed on the surface 24 of the printing cylinder 10 which can be used in conventional high volume lithographic printing operations.

Figure 1D:
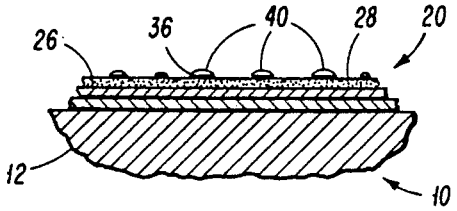

Referring now to FIG. 1D, during printing operations the printing cylinder 10 is rotated past dampening and inking rollers (not shown) whereby ink 40 is selectively applied to the oleophilic materials of the layer 36 and water is applied to the hydrophilic powder of the layer 26. The ink 40 is then printed off of the oleophilic materials of the layer 36 onto the substrate desired to be printed. FIG. 1D is provided to diagrammatically illustrate how the oleophilic materials comprising the layer 36 carry a discontinuous film of ink 40 to be delivered onto the substrate during printing operations.

Figure 1E:
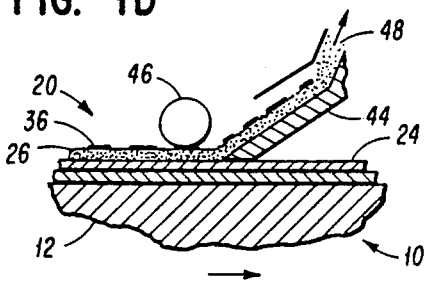

Referring now to FIG. 1E, the printing structure 20 including both the layer 36 of oleophilic materials and the layer 26 of hydrophilic powder is removed from the surface 24 of the printing cylinder 10 by the scraper blade 44 acting in combination with the counter magnet 46 which helps direct the particles of the powder coating layer 26 off of the surface 24 of the printing cylinder 10 by temporarily "demagnetizing" the surface of the cylinder 10. Additionally, vacuum action may be provided for urging the materials of the printing structure 20 away from the printing cylinder 10 into the channel 48. The printing structure 20 may thereby be entirely removed from the printing cylinder 10 and the cylinder returned to its original condition for application of a new printing structure when it is desired to print a new image.

Figure 2:
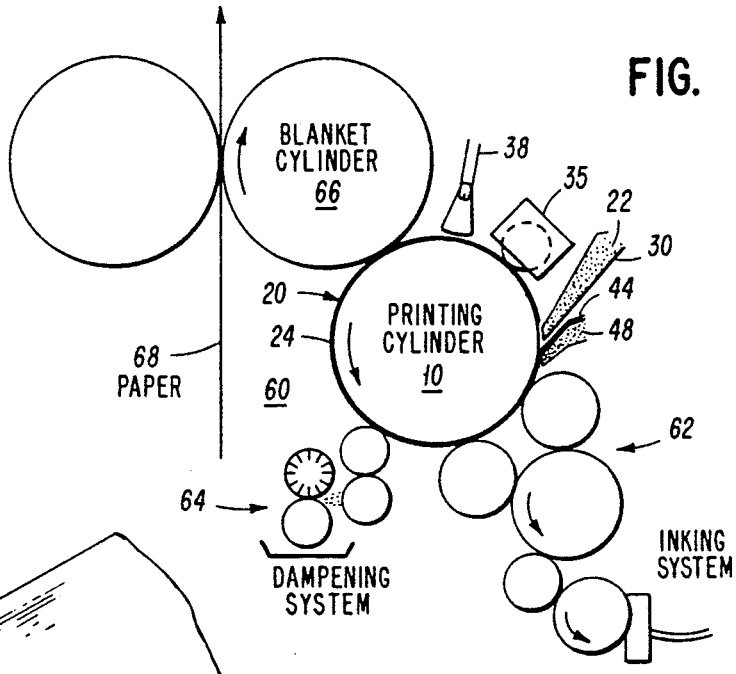
FIG. 2 provides a cross-section of a high speed newspaper print press roller configuration in which the imaging system of the present invention has been incorporated into the printing press assembly.

Referring now to FIG. 2, components for practicing the present invention are shown in conjunction with a high volume lithographic printing assembly 60 adapted for utilizing the present invention for forming a master-image printing structure 20 on a master-image cylinder 10. In operation, when it is desired to form a new master-image printing structure 20, the inking rollers 62, dampening rollers 64 and blanket cylinder 66 are retracted away from contact with the master-image carrying cylinder 10 while the scraper 44, hopper 30, drum 35 and radiant heater 38 are brought into position in contact with and alongside the master-image carrying cylinder 10. As previously described, the scraper 44 acts in conjunction with the channel 48 for removing previous image structure materials from the surface 24 of the cylinder 10. The hopper 30 functions to lay down a coating layer 26 of hydrophilic powder material which is magnetically adhered to the surface 24 of the master-image carrying cylinder 10. Oleophilic materials 34 are applied onto the surface 28 of the hydrophilic powder coating layer 26 in a formatted pattern by the action of the drum 35 which is intended to represent any of a number of systems for depositing oleophilic materials in an image-formatted pattern on the surface of the master-image printing cylinder 10. Finally, the radiant heater 38 is functional for fusing the oleophilic materials into durable patterns which are sufficiently robust to withstand the stresses inherent in high volume printing operations.

During actual printing operations the inking rollers 62, dampening rollers 64 and blanket cylinder 66 are placed in contact with the master-image cylinder 10 while the scraper 44, hopper 30, drum 35 and radiant heater 38 are retracted away from immediate proximity to the cylinder 10. The inking rollers 62 deliver oil-based ink onto the surface of the master-image carrying cylinder 10 which wets the oleophilic areas of the layer 36 of the printing structure 20. The damping rollers 64 deliver water onto the surface of the master-image carrying cylinder 10 which wets the hydrophilic areas of the layer 36 and helps to confine the ink to the oleophilic areas of the printing structure 20. As the master-image carrying cylinder is rotated the ink is transferred from the printing structure 20 onto the blanket cylinder 66 in image-formatted patterns a defined by the printing structure 20. The blanket cylinder 66 then applies the ink to the substrate 68 as the blanket cylinder is rotated and the substrate 68 is contacted by the surface of this cylinder. The printing processes performed by the assembly 60 are conventional while the system for forming the printing structure 20 on the surface of the master-image cylinder 10 is unique providing "disposable" printing image structures on a master-image cylinder.

Figure 5:
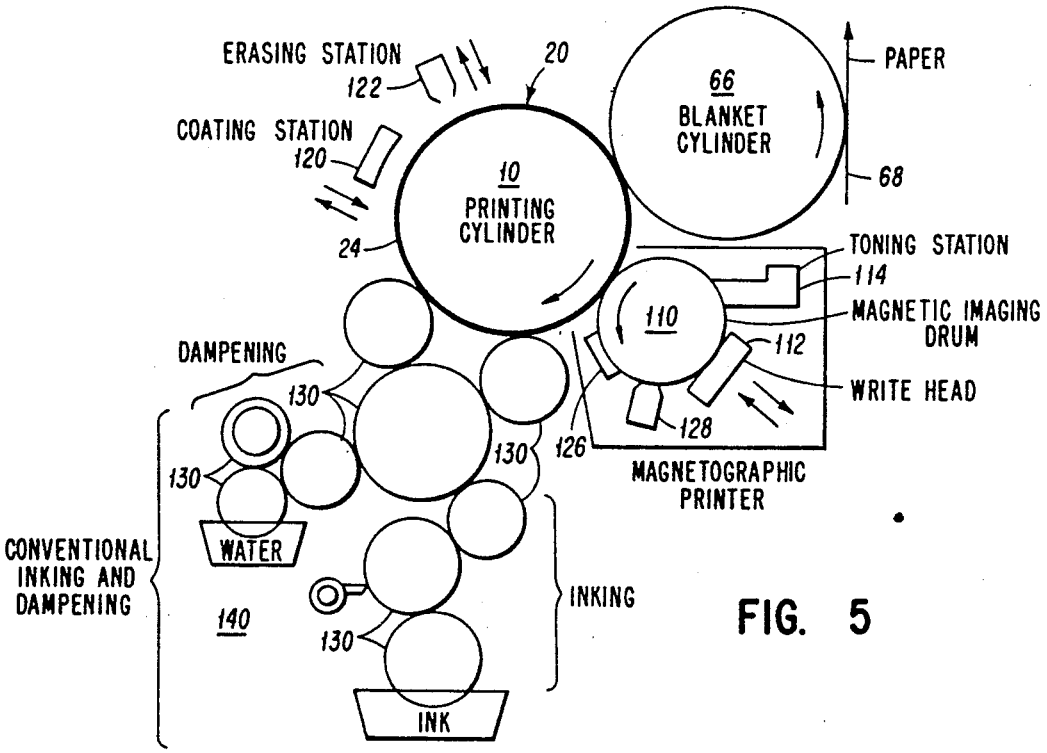
FIG. 5 provides a cross-sectional view of a printing press assembly including a magnetographic printer for applying oleophilic materials to a printing cylinder in image-formatted patterns in accordance with the principles of the present invention.
Figure 3:
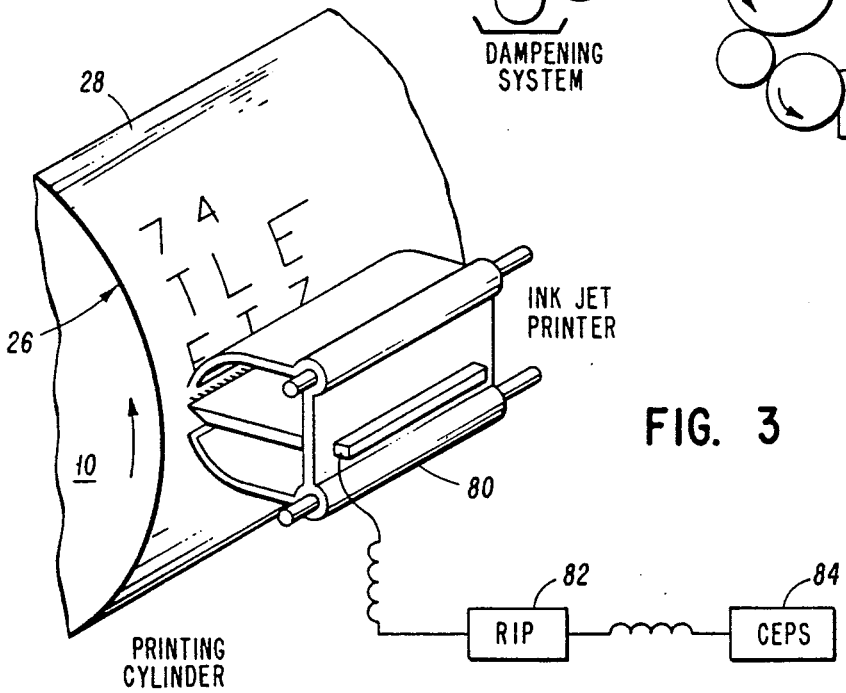
FIG. 3 provides a diagrammatic perspective view of an ink jet printer illustrating its use in applying oleophilic materials in image-formatted patterns in accordance with the principles of the present invention.
Figure 4:
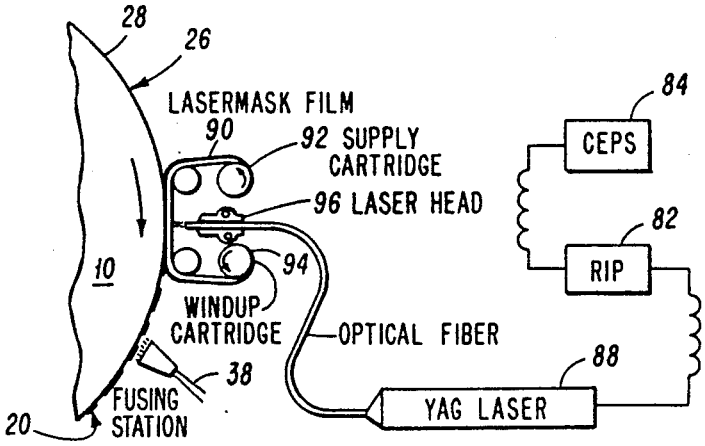
FIG. 4 provides a cross-sectional view of an apparatus designed to apply oleophilic materials to the surface of a printing cylinder in image-formatted patterns in accordance with the present invention using a laser mask film and a digitally controlled laser.

FIGS. 3, 4 and 5 provide examples of some real-image forming engines which have been adapted for use in forming printing structures in accordance with the present invention. Referring now to FIG. 3, an ink jet printer 80 is shown which has been suitably modified to controllably eject oleophilic and fusible materials directly onto the surface 28 of the magnetic powder coating layer 26 on the printing cylinder 10. The ink jet imaging engine 80 is addressed and controlled by digital electronic input signals representing rasterised pre-press graphic formatted images as generated by a raster image processing module 82 in response to information provided by a electronic pre-press composition system 84. The operation of the ink jet printer 80 is generally conventional with its printing operations being coordinated with the rotation of the master-image printing cylinder 10 so that the oleophilic materials can be deposited on the surface of the magnetic powder layer in formatted and registered patterns corresponding to the images desired to be printed.

Referring now to FIG. 4, a digitally controlled laser 88 is arranged for targeting one or more laser mask films 90 comprising for instance a heat transferable and fusible carbon-based coating applied to a clear support substrate which is held in close proximity to the surface 28 of the magnetic powder coating layer 26 on the printing cylinder 10. During operation, the laser mask film 90 is continuously unwound off of a supply cartridge 92 onto a wind-up cartridge 94 past a laser head 96. The printing cylinder 10 is rotated in line-by-line increments past the laser head 96 which is horizontally translated at the same time as the firing of the laser 88 is controlled by the raster image processing module 82 and the color electronic pre-press composition system 84 thereby depositing the oleophilic materials on the magnetic powder coating layer 26 by ablation or by laser melting and transfer in an image-formatted pattern corresponding to the image desired to be printed.

Referring now to FIG. 5, a different approach is shown for depositing oleophilic materials on the master-image printing cylinder 10 and forming the printing structure 20 of the present invention. In this embodiment a magnetographic printing assembly 100 is used for building up fusible toner in image-formatted patterns on the surface of a drum 110 in accordance with the well known principles for the operation of magnetographic printing equipment. The write head 112 is controlled by signals from a rasterised image processing module 82 and electronic pre-press composition system 84 to affect changes in magnetic characteristics on the surface of a magnetic imaging drum 110 as it is rotated past the write head 112. Fusible oleophilic toner is then applied at the toning station 114 and is deposited into image-patterns comprising real images formatted in accordance with the magnetically differentiated areas generated by the write head 112 on the surface of the drum 110. The cleaning and demagnetizing stations 126 and 128 restore the imaging drum 110 to its original condition. As the drum 110 is rotated past the printing cylinder 10 the toner is transferred onto the surface 28 of the magnetic powder coating layer 26 on the master-image printing cylinder 10 in the pattern corresponding to the image desired to be printed. A transfer roller may be positioned between the imaging drum 110 and the printing cylinder 10 to facilitate the transfer of toner off of the drum 110 and onto the printing cylinder 10. The base coating application station 120 and erasing station 122 represent mechanisms for laying down the hydrophilic layer 26 and for removing the printing structure 20 on the surface 24 of the printing cylinder 10 as previously described. It should be noted that the application and erasing stations 120 and 122 as well as the magnetographic printing assembly 100 are retracted from proximity with the master-image printing cylinder 10 during actual printing operations after the printing structure 20 has been built up o the printing cylinder 10. The rollers 130 and associated components represent a conventional inking and dampening system 140 for use during actual printing operations in applying both water and ink to the printing structure 20 on the surface 24 of the master-image printing cylinder 10. The blanket cylinder 66 transfers the printing ink off of the printing structure 20 on the master-image printing cylinder 10 onto the substrate 68 being printed.

Figure 6:
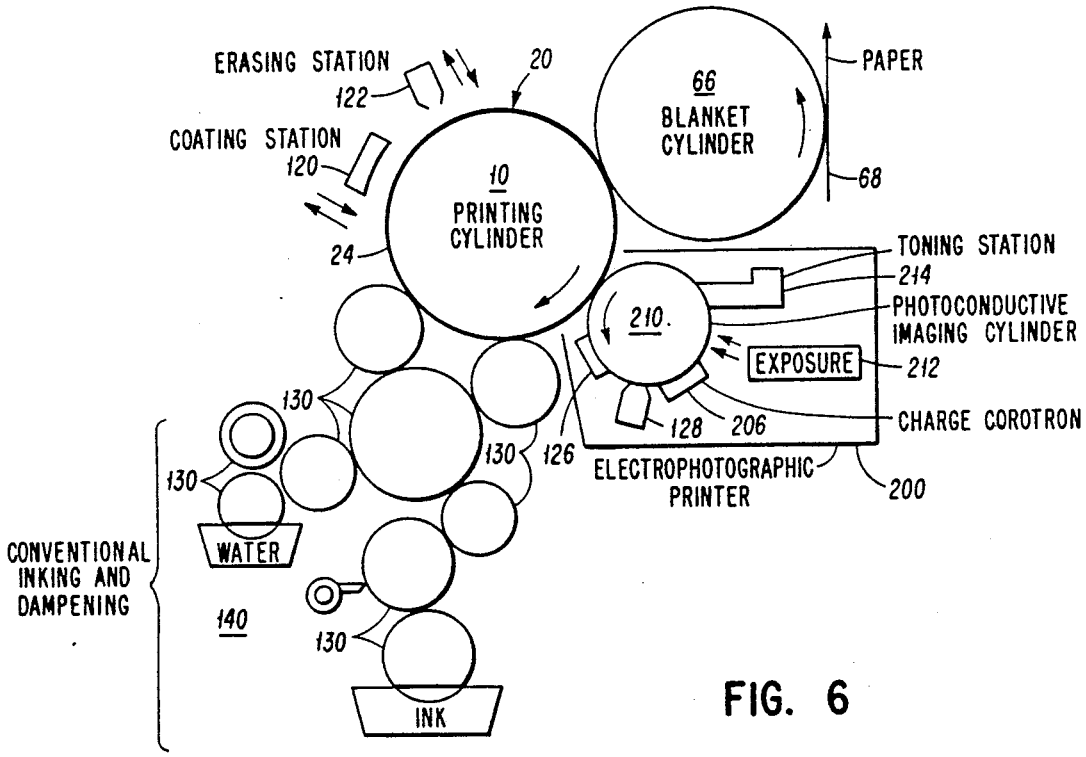
FIG. 6 provides a cross-sectional view of a printing press assembly including an electrophotographic printer for applying oleophilic materials to a printing cylinder in image-formatted patterns in accordance with the principles of the present invention.

Referring to FIG. 6, yet another means for forming oleophilic materials into image-formatted patterns on a printing cylinder 10 and generating the printing structure 20 of the present invention is shown. An electrophotographic image-forming assembly 200 deposits fusible oleophilic toner on the surface of an imaging drum 210 in image-formatted patterns according to the well known principles of operation of electrophotographic copying systems. The charge corotron 206 sets up a uniform electrical charge pattern on the surface of the drum 210. The exposure module 212 comprises a digitally-driven laser or LED and is controlled by digital signals from a rasterised image processing module 82 and electronic prepress composition system 84 to affect changes in electric charge retention on the photoconductive surface of drum 210 after rotation past the charge corotron 206. It should be noted that actual hard copy original materials could instead be used to reflection-expose the drum 210 using a light exposure procedure similar to conventional photography. Fusible oleophilic (and hydrophobic) material is then applied at the toning station 214 and is formed thereby into patterns on the imaging drum 210 consisting of real images formatted on the surface of the drum 210 in accordance with the electrophotographically differentiated pattern generated by the exposure module 212. The coating and erasing stations 120 and 122 restore the imaging drum 210 to its original condition. As the drum 210 is rotated past the printing cylinder 10 the toner is transferred onto the surface 28 of the magnetic powder coating layer 26 on the master-image printing cylinder 10 in the pattern corresponding to the image desired to be printed. A transfer roller may be positioned between the imaging drum 110 and the printing cylinder 10 to facilitate the transfer of toner off of the drum 110 and onto the printing cylinder 10. The coating station 120 and erasing station 122 represent mechanisms for laying down the hydrophilic layer 26 and for removing the printing structure 20 on the surface 24 of the printing cylinder 10 as previously described. It should be noted that the coating and erasing stations 120 and 122 as well as the electrophotographic printing assembly 200 are retracted from proximity with the master-image printing cylinder 10 during actual printing operations after the printing structure 20 has been built up on the cylinder 10. The rollers 130 and associated components represent a conventional inking and dampening system 140 for use during actual printing operations in applying both water and ink to the printing structure 20 on the surface 24 of the master-image printing cylinder 10. The blanket cylinder 66 transfers the printing ink off of the printing structure 20 on the master-image printing cylinder 10 onto the substrate 68 being printed.

While particular embodiments of the present invention have been shown and described, it should be clear that changes and modifications may be made to such embodiments without departing from the true scope and spirit of the invention. It is intended that the appended claims cover all such changes and modifications.

I claim:

1. A direct-to-press imaging system for use in lithographic printing wherein a master-image printing cylinder is used with separate application of ink and water onto its surface to enable repetitive conveyance of image-formatted ink films onto substrates for printing purposes, said imaging system comprising:

a master-image printing cylinder having a magnetizable surface layer;

means for applying a magnetically active hydrophilic powder onto the surface of said master-image printing cylinder to form a layer of hydrophilic powder on said surface;

means for transferring fusible oleophilic image material onto said hydrophilic powder layer in an image-formatted pattern;

means for fusing said fusible oleophilic material on said coating layer to thereby form a durable lithographic master printing image structure on said master-image printing cylinder having separate water and ink receptive areas corresponding to non-image and image areas of the format to be printed; and means for erasing said master printing image structure by removing said hydrophilic powder layer together with said fusible image material from said master-image printing cylinder.

2. The direct-to-press imaging system of claim 1, wherein said means for transferring fusible oleophilic image material comprises an ink jet printer.

3. The direct-to-press imaging system of claim 1, wherein said means for transferring fusible oleophilic image material comprises a digitally controlled laser which operates by ablation or laser melting to transfer oleophilic material from a carrier onto said hydrophilic powder layer in an image-formatted pattern.

4. The direct-to-press imaging system of claim 1, wherein said means for transferring fusible oleophilic image material includes means for forming a real image in a formatted pattern by application of a fusible toner onto the surface of an electromagnetically differentiated imaging drum.

5. The direct-to-press imaging system of claim 1, wherein said means for transferring fusible oleophilic image material includes means for forming a real image in a formatted pattern by application of a fusible toner onto the surface of an electrophotographically differentiated imaging drum.

6. The direct-to-press imaging system of claim 1, wherein said means for fusing said fusible oleophilic material comprises a radiant heating device.

7. The direct-to-press imaging system of claim 1, wherein said means for applying a magnetically active powder includes a roller constructed and arranged for applying pressure to said layer of hydrophilic powder.

8. The direct-to-press imaging system of claim 1, wherein said means for erasing said master printing image structure includes a scraper and means for demagnetizing said magnetizable surface layer on said cylinder.

9. The direct-to-press imaging system of claim 1, wherein said magnetically active powder comprises ferromagnetic particles encapsulated in a hydrophilic non-reactive material.

10. The direct-to-press imaging system of claim 1, wherein said printing cylinder includes a base layer and a highly magnetizable surface layer overlaying said base layer.

11. A direct-to-press imaging system for use in lithographic printing, comprising:

a master-image printing cylinder for use in lithographic printing operations;

means for forming a master printing image structure having separate hydrophilic and oleophilic areas corresponding ; to non-image and image areas on the surface of said printing cylinder by separately depositing hydrophilic and oleophilic materials directly on the surface of said cylinder so as to form image-formatted patterns; and means for removing said printing image structure including both said hydrophilic and oleophilic materials off of the surface of said cylinder and returning said cylinder to its original condition so that a new master printing image structure can be formed on the surface of said cylinder.

12. The direct-to-press imaging system of claim 11, wherein said printing cylinder includes a highly magnetizable surface layer, and said means for forming a master printing image structure includes:

means for uniformly applying a magnetically active hydrophilic layer onto the surface of said cylinder, means for transferring fusible oleophilic material onto said magnetically active layer in an image-formatted pattern, and means for fusing said fusible oleophilic material in order to form said master printing image structure.

13. The direct-to-press imaging system of claim 12, wherein said means for forming a master printing image structure includes an ink jet printer for depositing oleophilic material onto said hydrophilic layer on said cylinder in an image-formatted pattern.

14. The direct-to-press imaging system of claim 12, wherein said means for forming a master printing structure includes a digitally controlled laser which operates by ablation or laser melting to transfer oleophilic material from a carrier onto said hydrophilic layer in an image-formatted pattern.

15. The direct-to-press imaging system of claim 12, wherein said means for forming a master printing image structure includes a means for forming a real image in a formatted pattern by application of a fusible toner onto the surface of an electromagnetically differentiated imaging drum.

16. The direct-to-press imaging system of claim 12, wherein said means for forming a printing image structure includes a means for forming a real image in a formatted pattern by application of a fusible toner onto the surface of an electrophotographically differentiated imaging drum.

17. The direct-to-press imaging system of claim 12, wherein said means for fusing said fusible oleophilic material comprises a radiant heating device.

18. The direct-to-press imaging system of claim 12, wherein said means for removing said master printing image structure includes a scraper and a counter-magnet.

19. The direct-to-press imaging system of claim 12, wherein said magnetically active layer comprises ferromagnetic particles encapsulated in a hydrophilic non-reactive material.

20. A direct-to-press imaging process for use in lithographic printing methods wherein a master-image printing cylinder is used with separate water and ink application to the surface of said cylinder in order to enable repetitive conveyance of image-formatted ink films onto a substrate for printing purposes, said imaging process comprising the steps of:

forming a printing image structure having separate hydrophilic and oleophilic areas corresponding to non-image and image areas on the surface of said master-image printing cylinder by depositing hydrophilic and oleophilic materials directly on the surface of said cylinder in an image-formatted pattern; and removing said printing structure including both said hydrophilic and oleophilic materials off of the surface of said cylinder and returning said cylinder to its original condition so that a new printing image structure can be formed on the surface of said master-image printing cylinder.

21. The direct-to-press imaging process of claim 20, wherein said step of forming a printing image structure includes the substeps of applying a magnetically active hydrophilic material onto the surface of said cylinder to form a hydrophilic coating layer, transferring a layer of fusible oleophilic material onto said magnetically active coating layer in an image-formatted pattern, and fusing said fusible material to form said printing image structure.

22. The direct-to-press imaging process of claim 20, wherein said step of forming a printing image structure includes the substep of applying oleophilic material onto the surface of said cylinder using an ink jet printer.

23. The direct-to-press imaging process of claim 20, wherein said step of forming a printing image structure includes the substep of applying oleophilic material to said surface of said cylinder using a laser which operates by ablation or laser melting of oleophilic material supported on a carrier held in proximity to the surface of said cylinder.

24. The direct-to-press imaging process of claim 21, wherein said step of removing said printing structure includes the substeps of demagnetizing the surface of said master-image printing cylinder and scraping said printing structure off of and away from the surface of said master-image printing cylinder.

* * * * *